United States Patent [19]

Stotzel

[11] Patent Number: 4,863,308

[45] Date of Patent: Sep. 5, 1989

[54] WATERPROOFING COMPLEX FOR A ROAD STRUCTURE AND PROCESS FOR THE WATERPROOF ROAD LINING OF THE DECK OF A STRUCTURE

[75] Inventor: Marc Stotzel, Paris, France

[73] Assignee: Entreprise Jean Lefebvre, Neuilly sur Seine, France

[21] Appl. No.: 214,455

[22] Filed: Jul. 1, 1988

[51] Int. Cl.[4] ..... E01C 5/18

[52] U.S. Cl. ..... 404/31; 404/32; 427/138; 427/203; 427/204; 106/273.1; 106/277

[58] Field of Search ..... 404/17, 31, 32, 81, 404/82; 106/273.1, 276, 277; 427/136, 139, 138, 203, 204

[56] References Cited

U.S. PATENT DOCUMENTS 3,165,036 1/1965 Schmidt ..... 404/81 X
3,965,281 6/1976 Takase et al. ..... 404/81 X
4,728,683 3/1988 Smits et al. ..... 404/81 X

*Primary Examiner*—Stephen J. Novosad
*Assistant Examiner*—Gay A. Spahn
*Attorney, Agent, or Firm*—Mason, Kolehmainen, Rathburn & Wyss

[57] ABSTRACT

The present invention relates to a waterproofing complex for the deck of a road structure, which is intended to receive a surfacing course, the said complex comprising:

a bottom layer consisting of a mortar containing about 10 to about 15% of aggregate with a diameter of less than 80 μm, and from about 7.5 to about 9.5% of a bituminous binder based on elastomers, the percentages being expressed by weight relative to the dry aggregate, and a top layer consisting of a bitumen rich in elastomers.

It further relates to a process for the waterproof road lining of the deck of a structure.

14 Claims, No Drawings

WATERPROOFING COMPLEX FOR A ROAD STRUCTURE AND PROCESS FOR THE WATERPROOF ROAD LINING OF THE DECK OF A STRUCTURE

The present invention relates to a waterproofing complex for a road structure and to a process for the waterproof road lining of the deck of a structure.

Several techniques exist for the waterproofing of road structures. Among these techniques, there may be mentioned the spreading of asphalt and the spreading of a thin film, for example of the epoxy pitch type, adhering to the concrete deck of the structure. A waterproof device can also be produced by using prefabricated diaphragms.

These materials all have rather low efficiencies. Furthermore, when applied, they are sensitive to variations in atmospheric conditions.

Waterproofing a conventional structure, for example a bridge, by means of one of these techniques is a relatively lengthy process, delaying the opening of the structure.

Furthermore, conventional roadmaking equipment, such as distributors, cannot always be used with these techniques, which call for additional equipment as well as a substantial labor force.

The object of the present invention is to mitigate these disadvantages. More precisely, the object of the present invention is to provide a waterproofing complex of simple conception which has satisfactory technical characteristics and which is relatively insensitive to atmospheric conditions. This waterproofing complex is easy to lay and conventional roadmaking equipment, such as distributors, finishers and compactors, can be used to apply it.

The principal feature of the waterproofing complex of the present invention for a road structure is that it comprises:

- a bottom layer consisting of a mortar containing about 10 to about 15% of aggregate with a diameter of less than 80 μm, and from about 7.5 to about 9.5% of a bituminous binder based on elastomers, the percentages being expressed by weight relative to the dry aggregate, and
- a top layer consisting of a bitumen rich in elastomers.

According to one particular characteristic, the bottom layer of the said complex contains 8 to 9% of bituminous binder based on elastomers.

According to another characteristic, the said elastomers of the bottom and top layers are of the same type.

These elastomers are homopolymers or copolymers such as ethylene/vinyl acetate (EVA), styrene/butadiene block copolymers and mixtures thereof.

According to another characteristic of the present invention, the top layer also contains about 1 to about 4% by weight of a resin, especially a terpene resin.

According to another characteristic, the bituminous binder of the said bottom layer contains about 3 to about 11% by weight of elastomers, especially ethylene/vinyl acetate.

The bitumen of the top layer will preferably contain about 5 to about 20% by weight of elastomers, especially ethylene/vinyl acetate.

Finally, the bottom layer has a thickness of between about 2 and about 4 centimeters, while the thickness of the top layer is between about 1.5 and about 3 millimeters.

The present invention further relates to a process for the waterproof road lining of the deck of a structure, which comprises carrying out the following operations:

(a) a cold-impregnating varnish, or a bonding layer based on special bitumen/elastomer emulsion, is spread directly onto the deck of the structure, (b) the bottom layer and then the top layer of the waterproofing complex according to the present invention are spread in succession, (c) the surface of the said complex is sanded or coated, and (d) a surfacing course is spread.

According to one particular characteristic, the said surfacing course is a bituminous mix containing elastomers of the same type as those used in the waterproofing complex.

Finally, according to another characteristic, following step (a):

- the kerbstones and other raised parts of the said structure are waterproofed by applying a waterproofing material against the said kerbstones so that it either falls back or penetrates,
- the said bottom layer of the waterproofing complex is spread so as to stop short of the said kerbstones, and
- the space thereby created is filled when the said top layer is applied.

Further advantages and characteristics of the present invention will become apparent in the course of the detailed description which follows.

The percentages used throughout the description and the claims are expressed by weight relative to the dry aggregate.

The waterproofing complex of the present invention has essentially two parts: a bottom layer and a top layer.

The bottom layer consists of a mortar and a bituminous binder based on elastomers. The mortar contains about 10 to about 15% of aggregate with a diameter of less than 80 μm.

This can be, for example, a mixture of crushed or ground sand of grain size 0–2, round sand of grain size 0–2 to 0–4 and crushed sand of grain size 2–4. It is also possible to use a mortar of grain size 0–2 or a microfine sand-gravel mix of grain size 0–6.

This first layer makes it possible to level the structure to be covered and provide initial waterproofing. A mortar of the type described above has a compactness of 96 to 98%. Permeability tests were carried out with the aid of an EDF permeameter. The coefficient is less than $10^{-12}$ meters/second. The mortar is therefore waterproof.

The bituminous binder based on elastomer (sic) represents about 7.5 to about 9.5% and preferably 8 to 9% of the mass of dry aggregate. The elastomers used are homopolymers or copolymers. Particularly preferred copolymers are ethylene/vinyl acetate (EVA), styrene/butadiene block copolymers and mixtures thereof.

The top layer of the waterproofing complex consists of a bitumen rich in elastomers. Preferably, the elastomers used will be of the same type as those present in the bottom layer.

The use of elastomers makes it possible to give the complex better cohesion, better resilience and good adhesion to the base. Furthermore, using the same elastomers in both layers makes it possible to limit the number of raw materials and hence to facilitate the preparation of the complex.

The top layer of the complex can also contain a resin in proportions ranging from about 1 to about 4% by weight. Terpene resins are particularly preferred for this purpose.

The thickness of the bottom layer will preferably be between about 2 and about 4 cm, while the thickness of the top layer will vary between about 1.5 and about 3 mm (which approximately corresponds to 1.5 to 3 kg/m$^2$ of bitumen based on elastomers).

This particular type of waterproofing complex based on aggregates and bitumen can be applied using traditional high-efficiency roadmaking machinery such as pressure distributors. This reduces the production times and production costs.

The waterproof lining of a road structure may be carried out in the following manner:

a cold-impregnating varnish, or a bonding layer based on special bitumen/elastomer emulsion is spread directly onto the deck of the structure, the bottom layer and then the top layer of the waterproofing complex according to the present invention are spread in succession, the surface of the said complex is sanded or coated, and a surfacing course is spread.

This process has the advantage that it can be carried out using traditional roadmaking equipment such as bitumen distributors, i.e. high-efficiency road-making equipment.

By sanding the surface of the complex, the tires of the machinery can be prevented from pulling up part of the complex which has already been laid, when this machinery is used to spread a surfacing course. This sanding also has a shielding effect, thereby restricting the reverse percolation phenomena due to the raised areas of bituminous binder on the surface. The amount of sand spread can be of the order of 2 to 3 1/m$^2$. This sanding can advantageously be replaced by coating or dusting with flakes of slate or similar materials from the family of the shales.

Waterproofing along the kerbstones and the various raised parts is difficult to effect and must consequently be carried out with care. According to the process of the present invention, it can be done by placing a waterproof material of conventional type, for example in the form of prefabricated sheets, along the kerbstones and other raised parts after the cold-impregnating varnish or the bonding layer has been spread. The bottom layer of the complex is then spread so as to stop short of the said kerbstones. The peripheral space created in this way is filled when the top layer is applied. Such waterproofing can also advantageously be achieved in certain cases by the application, in particular by spraying, of a fluid waterproofing material known per se.

It should be noted here that it is possible to use a surfacing course composed of a bituminous mix containing elastomers of the same type as those used in the waterproofing complex. This greatly facilitates the construction work by limiting the number of raw materials to be employed, as stated above. Furthermore, the lining thereby has a degree of homogeneity.

What is claimed is:

1. A waterproofing complex for a road structure, which is intended to receive a surfacing course, the said complex comprising:

a bottom layer consisting of a mortar containing about 10% to about 15% of an aggregate with a diameter of less than 80 μm, and from about 7.5% to about 9.5% of an elastomer-based bituminous binder, the percentages being expressed by weight relative to the dry aggregate, and a top layer consisting of a bitumen rich in elastomers.

2. The waterproofing complex according to claim 1, wherein said bottom layer contains 8 to 9% of an elastomer-based bituminous binder the percentage being expressed by weight relative to the dry aggregate.

3. The waterproofing complex according to claim 1, wherein said elastomers of the bottom and top layers are of the same type.

4. The waterproofing complex according to claim 3, wherein said elastomers are homopolymers or copolymers such as ethylene/vinyl acetate (EVA), styrene/-butadiene block copolymers (SBS) and mixtures thereof.

5. The waterproofing complex according to claim 1, wherein said top layer includes about 1% to about 4% by weight of a resin based upon the weight of said top layer.

6. The waterproofing complex according to claim 1, wherein the elastomer-based bituminous binder of the bottom layer includes about 3% to about 11% by weight of an elastomer.

7. The waterproofing complex according to claim 1, wherein said bitumen of the top layer includes about 5% to about 20% by weight of an elastomer.

8. The waterproofing complex according to claim 1, wherein:

said bottom layer has a thickness of between about 2 and about 4 centimeters, and said top layer has a thickness of between about 1.5 and about 3 millimeters.

9. A process for producing a waterproof road structure comprising:

(a) spreading a cold-impregnating varnish, or a bonding layer based on a bitumen/elastomer emulsion, directly onto the structure, (b) spreading a bottom layer consisting of a mortar containing about 10% to about 15% of aggregate with a diameter of less than 80 μm, and from about 7.5% to about 9.5% of an elastomer-based bituminous binder, the percentages being expressed by weight relative to the dry aggregate, and spreading a top layer consisting of a bitumen rich in elastomers in succession, (c) sanding or coating the surface, and (d) spreading a surfacing course.

10. The process according to claim 9, wherein the surfacing course is a bituminous mix containing elastomers of the same type as those spread directly onto the structure.

11. The process according to claim 9 wherein, following step (a):

waterproofing along the kerbstones and other raised parts of said structure is effected by applying a waterproofing material against the said kerbstones so that said waterproofing material either falls back or penetrates, spreading the said bottom layer of the waterproofing complex so as to stop short of the said kerbstones, and thereby filling the peripheral space created when the said top layer is applied.

12. The waterproofing complex according to claim 5, wherein the resin is a terpene resin.

13. The waterproofing complex according to claim 6, wherein the elastomer is ethylene/vinyl acetate.

14. The waterproofing complex according to claim 7, wherein the elastomer is ethylene/vinyl acetate.

* * * * *